US007546937B2

(12) United States Patent
Kondo et al.

(10) Patent No.: US 7,546,937 B2
(45) Date of Patent: Jun. 16, 2009

(54) POURED MOLTEN METAL QUANTITY CONTROL DEVICE

(75) Inventors: Tsuneo Kondo, Tokyo (JP); Ryuzo Nishimachi, Kanagawa (JP); Tomohiro Yotabun, Tokyo (JP); Hisao Inubushi, Tokyo (JP)

(73) Assignee: JFE Engineering Corporation, Tokyo (JP)

( * ) Notice: Subject to any disclaimer, the term of this patent is extended or adjusted under 35 U.S.C. 154(b) by 164 days.

(21) Appl. No.: 10/582,472

(22) PCT Filed: Dec. 21, 2004

(86) PCT No.: PCT/JP2004/019071

§ 371 (c)(1),
(2), (4) Date: Feb. 8, 2007

(87) PCT Pub. No.: WO2005/061155

PCT Pub. Date: Jul. 7, 2005

(65) Prior Publication Data

US 2007/0176335 A1 Aug. 2, 2007

(30) Foreign Application Priority Data

Dec. 24, 2003 (JP) ..... 2003-427221

(51) Int. Cl.
*C21C 5/42* (2006.01)

(52) U.S. Cl. ..... 222/600

(58) Field of Classification Search ..... 222/597, 222/600; 266/236

See application file for complete search history.

(56) References Cited

U.S. PATENT DOCUMENTS

| | | | | |
|---|---|---|---|---|
| 3,764,047 | A | 10/1973 | Inoue et al. | |
| 3,921,866 | A | 11/1975 | Palazzo | |
| 4,480,771 | A | 11/1984 | Meier | |
| 4,591,080 | A * | 5/1986 | Yoshihara | 222/600 |
| 4,848,604 | A | 7/1989 | Fricker | |

FOREIGN PATENT DOCUMENTS

| | | |
|---|---|---|
| EP | 0 223 561 A1 | 5/1987 |
| EP | 0 357 227 | 3/1990 |
| EP | 0 357 227 A1 | 3/1990 |
| JP | 48-4697 | 10/1973 |
| JP | 55-158878 A | 12/1980 |
| JP | 62-156068 A | 7/1987 |

(Continued)

OTHER PUBLICATIONS

Patent Abstracts of Japan 01 262061 dated Oct. 18, 1989.

(Continued)

*Primary Examiner*—Scott Kastler
(74) *Attorney, Agent, or Firm*—Ladas and Parry LLP

(57) ABSTRACT

A poured molten metal quantity control device includes a fixed plate brick having at least one pouring port, a collector nozzle brick, a slide plate brick sandwiched therebetween, an outer race mounted so as to be turned on the outer peripheral side of the fixed plate brick by an extendable unit, and a frame having the slide plate brick mounted thereon that is mounted on the outer race through a pivotal hinge so as to be capable of opening and closing movements. The frame can be opened and closed through the pivotal hinge independently of the turning of the outer race with the extendable unit.

10 Claims, 6 Drawing Sheets

(a) (b)

FOREIGN PATENT DOCUMENTS

| | | |
|---|---|---|
| JP | 62-58816 | 8/1987 |
| JP | 1-38592 | 8/1989 |
| JP | 01 262061 | 10/1989 |
| JP | 02 052 165 | 2/1990 |
| JP | 02-52165 A | 2/1990 |
| JP | 5-200533 | 8/1993 |
| LU | 37 533 | 10/1959 |

OTHER PUBLICATIONS

Patent Abstracts of Japan 02 052 165 dated Feb. 21, 1990.
Patent Abstract of Japan 62-156068 A Published Jul. 11, 1987.
Patent Abstract of Japan 02-52165 A Published Feb. 21, 1990.
Patent Abstrct of 05-200533; Kokan Kikai Kogyo KK; Rotary Nozzle; Aug. 1993.
Patent Abstract of 05-200533; Kokan Kikai Kogyo KK; Rotary Nozzle; Aug. 1993.

* cited by examiner (a) (b)

(a) (b)

POURED MOLTEN METAL QUANTITY CONTROL DEVICE

TECHNICAL FIELD

The present invention relates to a poured molten metal quantity control device mounted on the bottom of a molten metal vessel such as a ladle and a tundish to control the pouring feed rate of the molten metal by sliding a slide plate brick to adjust the relative degree of opening of a pouring port thereof to a pouring port of a fixed plate brick.

BACKGROUND ART

A poured molten metal quantity control device ordinarily includes a fixed plate, which has a pouring port and is composed of a refractory detachably mounted on a base plate fixed to a ladle and the like, and a slide plate, which has a pouring port and is composed of a refractory detachably mounted on a slide frame, and controls the pouring feed rate of the molten metal by adjusting the degree of opening between the pouring port of the fixed plate and the pouring port of the slide plate by a slide system for linearly sliding the slide plate along the base plate.

A metal slide system and a roller slide system are available as the slide system of the slide frame in the poured molten metal quantity control device employing the linear slide system, and the basic structure of the metal slide system is widely known and used from the beginning of development of this type of apparatuses to the present (refer to, for example, Japanese Patent Publication Nos.1-38592 and 48-4697 (U.S. Pat. Nos. 4,848,604 and 730870).

In the metal slide system, since a slide plate is pressed against a fixed plate through a slide frame by a hydraulic cylinder and the like to thereby linearly move the slide plate, the metal slide system is advantageous in that the positions at which the degree of opening of a pouring port is completely opened or closed can be obtained with relatively high accuracy.

However, to slide the slide frame to adjust the degree of opening of the pouring port, there is required drive force larger than the sum of the friction force generated on the slide surface between the fixed plate and the slide plate and the friction force generated on the slide surface between the slide frame and a guide member thereof.

Further, since the slide frame and the guide member thereof are worn, they must be replaced, for example, about every 500 heats. Accordingly, maintenance cost such as a disassembly and adjustment cost, parts cost, and the like increases, and further a troublesome job is required to apply a lubricant onto the slide surface between the fixed plate and the slide plate and onto the slide surface between the slide frame and the guide member.

The roller slide system is developed to overcome the problem of friction force in the metal slide system described above (refer to, for example, Japanese Patent Publication No. 62-58816 (U.S. Pat. No. 4,728,014). The roller slide system can reduce the friction force generated at the time when a slide plate is slid, by using a roller, and further can reduce apparatus cost and maintenance cost. However, since the point of action of the roller to the periphery of a pouring port of the slide plate shifts and thus press force exerted to the periphery of the pouring port lacks balance, from which a possibility arises in that the press force is reduced on the periphery of the pouring port.

In contrast to these linear slide type poured molten metal quantity control devices, there is available a rotary type poured molten metal quantity control device which relatively changes respective pouring ports from a completely open position to a completely close position by slidingly turning a slide plate brick with respect to a fixed plate brick. The rotary type poured molten metal quantity control device is advantageous in that it is comparatively compact because a worm device and the like are used as a means for turning a slide plate brick in contrast that the linear slide type poured molten metal quantity control device requires an additional expansion length corresponding to the stroke of the slide plate, press force is exerted in relatively good balance, the maintenance of device is easy, and total cost can be reduced because of the extended life of a refractory. Thus, many small to large rotary type poured molten metal quantity control devices are used as poured molten metal quantity control devices (refer to Japanese Patent Publication No. 5-200533).

FIG. 9 is a view showing an example of a conventional rotary type poured molten metal quantity control device that controls a pouring feed rate by controlling the degrees of opening of a pouring port of a fixed plate brick 20 and a pouring port of a slide plate brick 50 from a completely open position to a completely close position by the sliding turn angle of the slide plate brick 50 that slidingly turns in contact with the fixed plate brick 20. The turning operation is executed by a worm 90 and a worm gear 91 coupled with a frame 70 for supporting the slide plate brick 50.

However, when the slide plate brick 50 is turned to the completely open/close positions of the pouring ports by an electric motor or a hydraulic motor through the worm gear 91, a worker must stop the slide plate brick 50 at the completely open/close positions by observing marks or by detecting the positions of the pouring ports by a turn angle sensor. Accordingly, more prudence is required to the workability for controlling the pouring feed rate, and a manipulation is somewhat troublesome and takes a long time.

FIG. 10 is a view showing an example of a conventional linear slide type poured molten metal quantity control device. The conventional poured molten metal quantity control device controls a pouring feed rate by controlling the degrees of opening of a pouring port of a fixed plate brick 200 and a pouring port of a slide plate brick 500 from a completely open position to a completely close position by the slide amount of the slide plate brick 500 that linearly slides in contact with the fixed plate brick 200 fixed to a base plate 100. The sliding operation is executed by a rod stroke of a hydraulic cylinder 900. The linear slide type poured molten metal quantity control device is advantageous in that since operation start and end positions can be firmly determined by the rod stroke, a control can be securely carried out by matching the completely open/close positions of the pouring ports to the operation start and end positions.

However, in a conventional door type poured molten metal quantity control device, in which a fixed plate brick or a slide plate brick is replaced or used after it is reversed as a countermeasure executed in an actual job to against bricks worn in the vicinities of pouring ports, when a door is opened and closed, a door side must be disconnected from a drive side by any means. That is, in FIG. 10, a coupling portion 910 between the hydraulic cylinder 900 and a support portion 700 of the slide plate brick 500 must be made in a separable type, and a trouble job for separating the coupling portion 910 must be executed each time the brick is reversed. As long as the conventional door type is employed, this job is indispensable in any of the slide system and the rotary system.

Patent Document 1: Japanese Examined Patent Application Publication No. 1-38592 (column 3, lines 1-26, FIG. 2)
Patent Document 2: Japanese Examined Patent Application Publication No. 48-4697 (column 2, lines 21-30, FIG. 2)

Patent Document 3: Japanese Examined Patent Application Publication No. 62-58816 (column 3, lines 1-26, FIG. 2)

Patent Document 4: Japanese Unexamined Patent Application Publication No. 5-200533 (column 3, lines 22-34, FIG. 1)

DISCLOSURE OF THE INVENTION

Problems to be Solved by the Invention

As described above, there is a strong requirement for a highly efficient, economical, and convenient poured molten metal quantity control device that makes use of the respective advantages of a rotary system and a linear slide system to a conventional poured molten metal quantity control device and eliminates a troublesome job for disconnecting the coupling between a door side and a drive side each time a brick position reversing job is executed.

Means for Solving the Problems

In a poured molten metal quantity control device of the present invention, 1) a poured molten metal quantity control device used in a rotary pouring apparatus comprises the following items (1)-(5):

(1) a fixed plate brick mounted on the bottom of a molten metal vessel through a base plate and having at least one pouring port;

(2) a collector nozzle brick disposed in confrontation with the fixed plate brick, with its pouring port located concentrically;

(3) a slide plate brick sandwiched between the collector nozzle brick and the fixed plate brick in contact therewith so as to slidingly turn on the sliding surfaces of the collector nozzle brick and the fixed plate brick and having at least one pouring port;

(4) a flame on which the slide plate brick is mounted;

(5) an outer race mounted so as to be turned on the outer peripheral side of the fixed plate brick by an extendable unit, and further, the poured molten metal quantity control device is characterized in that:

the device controls the pouring amount of the molten metal by adjusting the relatively open position of the pouring port of the slide plate brick and the pouring port of the fixed plate brick by turning the outer race by the extendable unit;

the flame is attached to the outer race through a pivotal hinge so as to be capable of open and closed operation by a hinge irrespectively of the turning means of the outer race comprising the extendable unit, and the outer race is turned by a crank mechanism using triangle points consisting of a support pivot P1 for supporting the extendable unit, the center of turn P3 of the outer race, and a pivot P2 engaged with an end of an extendable rod of the extendable unit disposed to the outer peripheral portion of the outer race, and the stroke of the extendable unit and the position of the support pivot P1 of the extendable unit are selected to cause a completely open position, at which the pouring port of the slide plate brick is matched with the pouring port of the fixed plate brick, to act as an end position and a position turned from the end position by a predetermined angle to act a start position.

That is, with this structure, when a brick position reverse job is carried out in a door type poured molten metal quantity control device, a door can be opened a closed irrespectively of a turn system. Further, the completely open/close positions of the pouring ports can be fixed to the relative positions of the end and start positions of the stroke of the extendable unit.

Further, in a poured molten metal quantity control device of the present invention, 2) a poured molten metal quantity control device used in a rotary pouring apparatus comprises the following items (1)-(5):

(1) a fixed plate brick mounted on the bottom of a molten metal vessel through a base plate and having at least one pouring port;

(2) a collector nozzle brick disposed in confrontation with the fixed plate brick, with its pouring port located concentrically;

(3) a slide plate brick sandwiched between the collector nozzle brick, and the fixed plate brick in contact therewith so as to slidingly turn on the sliding surfaces of the collector nozzle brick and the fixed plate brick and having at least one pouring port;

(4) a flame on which the slide plate brick, into which the slide plate brick is internally fitted, is mounted, (5) an outer race into which a fixed plate having the fixed plate brick is internally fitted and which is mounted so as to turned on an outer peripheral side by an extendable unit, and further, the poured molten metal quantity control device is characterized in that: the device controls the pouring amount of the molten metal by adjusting the relatively open position of the pouring port of the slide plate brick and the pouring port of the fixed plate brick by turning the outer race with the extendable unit;

the flame, the slide plate, and the fixed plate are attached to the outer race through pivotal hinges on coaxial hinge shafts, respectively so as to be capable of open and close operation on the pivotal hinges irrespectively of the turning means of the outer race comprising the extendable unit; and the outer race is turned by a crank mechanism using triangle points consisting of a support pivot P1 for supporting the extendable unit, the center of turn P3 of the outer race, and a pivot P2 engaged with an end of an extendable rod of the extendable unit disposed to the outer peripheral portion of the outer race, and the stroke of the extendable unit and the position of the support pivot P1 of the extendable unit are selected to cause a completely open position, at which the pouring port of the slide plate brick is matched with the pouring port of the fixed plate brick, to act as an end position and a position turned from the end position by a predetermined angle to act a start position.

With this structure, a brick position reverse job due to wear and the like can be carried out irrespectively of a turn system also in a double door type poured molten metal quantity control device. Further, the completely open/close positions of the pouring ports can be fixed to the relative positions of the terminate and start positions of the stroke of the extendable unit.

Further, in a poured molten metal quantity control device of the present invention is arranged such that:

3) in the item 1) or 2) described above, the extendable unit is composed of a hydraulic cylinder unit;

4) in the item 1) or 2) described above, the extendable unit is composed of a screw type unit;

5) in the item 1) or 2) described above, the extendable unit is composed of a rack/pinion type unit;

6) in the items 1) to 5) described above, the end position and the start position respectively correspond to the stroke 0 and entire length positions of the extendable rod of the extendable unit.

7) in the items 1) to 6) described above, the turn angle θ between the radius of turn of the start position and the center line connecting between the support pivot P1 and the pivot P2 is 90°±30°; and 8) in the items 1) to 7) described above, the pouring port of the fixed plate brick and the pouring port of the slide plate brick are two or three pouring ports disposed in symmetry with respect to a turn direction.

That is, a unit member of a conventionally used poured molten metal quantity control device can be easily reused, and an extendable unit having a more proper and small capacity can be selected by properly selecting the respective pivot positions.

Further, a poured molten metal quantity control device of the present invention is arranged such that:

9) in the items 1) to 8) described above, the slide plate brick is internally mounted in a sliding plate case reversibly attached to the frame; and 10) in the item 9) described above, the fixed brick is further reversibly attached to a bottom plate case engaged with the base plate through a hinge.

That is, with this arrangement, a job for reversing the slide plate brick and the fixed brick can be more simply and promptly carried out.

[Advantages]

(1) With the structure described above in the item 1) or 2), the present invention can provide a highly efficient and convenient poured molten metal quantity control device that can easily reverse the positions of a fixed plate brick and a slide plate brick without separating a turn system and can match the completely open and close positions of pouring ports to the stroke end and start positions of an extendable unit. Further, the present invention can also obtain superiority in refractory cost, machine equipment cost, maintenance cost, and the like.

(2) With the structures described above in the items 3) to 5), the present invention can provide a more effective and convenient poured molten metal quantity control device suitable for a working field. Further since components from conventionally used poured molten metal quantity control device can be reused, superiority can be obtained in machine equipment cost and maintenance cost.

(3) With the structures described above in the items 6) to 10), the present invention can provide a highly effective and highly convenient poured molten metal quantity control device at less expensive cost because the capacity of an extendable unit can be reduced.

BEST MODE FOR CARRYING OUT THE INVENTION

In a single or double type poured molten metal quantity control device, a best mode for embodying the present invention has the following structure to make a reversing job easily which is carried out to dislocate the position of a fixed plate brick and a slide plate brick that are worn mainly in a pouring port portion as well as to securely and easily obtain the complete open/close positions of a pouring port. More specifically, the structure is arranged such that:

A) a turn system for opening and closing the pouring port is not affected by the operation of a door open/close system;

B) the completely open/close positions of the pouring port are given as the fixed positions of stroke start/end positions in an extendable unit of the turn system; and C) the maximum value of the turn torque of the extendable unit sets respective pivot positions P1, P2, P3 at the positions at which the turn torque for driving a slide plate brick is maximized, that is, at which a k value (ratio of turn torque T and the axial force F of extendable unit) is set to approximate 1.

The respective advantages of the rotary system and the linear slide system can be capitalized by the structure.

EMBODIMENT 1

FIG. 1 is a schematic view showing a structure of a single door type in an embodiment 1 of the present invention, wherein FIG. 1(*a*) is a view observed from a pouring side, and FIG. 1(*b*) is a view observed from a side surface.

FIG. 2 is an explanatory view schematically showing a structure of the embodiment 1.

In the figure, 1 denotes a base plate, 2 denotes a fixed brick, 3 denotes a fixed plate, 4 denotes an outer race, 5 denotes a slide plate brick, 6 denotes a slide plate case, 7 denotes a frame, 8 denotes a hydraulic cylinder, and 9 denoted a cylinder pivot portion.

A poured molten metal quantity control device according to the present invention is mounted on the bottom and the like of a molten metal vessel by a base plate 1, and is equipped with an outer race 4 which is fitted around and engaged with the outer periphery of a fixed plate 3, that is fixed to the base plate 1 for supporting a fixed plate brick 2, so as to be rotatable by the hydraulic cylinder 8, and with a frame 7 which is engaged with a hinge portion 42 fixed to the outer race 4. The frame 7 is provided with the slide plate brick 5, which turns in sliding contact with the surface of the fixed plate brick 1, and with the slide plate case 6 for supporting the slide plate brick 5 in the frame.

The hydraulic cylinder 8 is engaged with a coupling end portion 82 disposed at the end of a cylinder rod 81 of the hydraulic cylinder 8 through a pivot in a coupling portion 41 disposed to the outer race. Further, the hydraulic cylinder 8 is engaged with a cylinder pivot 9 for externally supporting the hydraulic cylinder 8 so that it can be moved pivotally.

A link mechanism is arranged which uses three points as contact points, that is, an engagement pin P2, which engages the coupling portion 41 with the coupling end portion 82, a support pivot P1 at the engagement portion of the cylinder pivot portion 9 with the hydraulic cylinder 8, and the center of turn P3 of the outer lace 4 and which uses the distance H between P1 and P3, the radius of turn of the outer lace 4 (distance between P2 and P3) R, and the distance Lx between P1 and P2 created by the rod stroke of the hydraulic cylinder as three link elements.

In the embodiment, the stroke $L_0$ of the hydraulic cylinder 8 corresponding to the rotation angle $\theta_0$ between a completely open position A and a completely close position B is matched to the entire stroke Lc of the hydraulic cylinder 8 ($L_0=L_c$). With this arrangement, since a turn stop position is settled. Thus, a working efficiency can be greatly improved as compared with a conventional turn system using a worm gear system because a job can be carried out without adjusting a stop position visually and the like. Further, the cost of the turn system itself can be greatly reduced.

Further, in the embodiment, the coupling end portion 82 of the hydraulic cylinder 8 is coupled only with the outer race 4 and is not directly coupled with the frame 7 in which the slide plate brick 5 is accommodated. With this arrangement, the frame 7 can be pivotally released from the outer race 4 through the hinge portion 42 without being disconnected from the hydraulic cylinder, thereby the positions of the fixed plate brick 2 and the slide plate brick 5 that are worn can be easily reversed.

FIG. 5 is an explanatory view explaining steps of reversing the positions of the fixed plate brick 2 and the slide plate brick 5. FIG. 5(*a*) shows STEP 1 and FIG. 2 shows STEP 2. At STEP 1, (1) the frame 7 is opened up to 120° after a lock nut of a clamp for fixing the frame 7 is loosened, and then (2) after the slide plate brick 5 and the fixed brick 2 are removed, the positions thereof are reversed and then they are mounted again. At STEP 2, a door (frame 7) is closed.

Main specifications of the poured molten metal quantity control device of the embodiment are as shown below.

Unit: mm

Fixed plate brick: anomalous elliptical shape (major axis 370×minor axis 260×thickness 35)

pouring port 2 (diameter 50ϕ), distance between centers 165

Slide plate brick: anomalous elliptical shape (major axis 322×minor axis 260×thickness 35)

pouring port 2 (diameter 50ϕ), distance between centers 150

Radius of turn of outer race R: R=420

Turn angle: 90° (θ=30° to 120°)

Distance H between P1, P3:

(Center of turn P3 of outer race, support pivot P1 of hydraulic cylinder) 852.5

Hydraulic cylinder: (ϕ63×475 ST) pressure in use P=5 to 10 Mpa

Substantial working pressure 8 MPa

Hinge position of frame: (distance from the center of turn of outer race) 222.5

The lower surface of an upper nozzle brick having a 50ϕ pouring port coupled with the bottom of the molten metal vessel is fixed to the fixed plate brick 2 in contact therewith, with the respective pouring ports concentrically disposed. Further, the upper surface of a collector nozzle brick, which has a 50ϕ pouring port for pouring molten metal to a ladle and the like, is fixed to the lower surface of the slide plate brick 5 in contact therewith, with the respective pouring ports concentrically disposed.

A job for intermittently pouring molten cast iron of 1550° C. was carried out 100 times by the poured molten metal quantity control device of the embodiment. The job was carried out at a cycle of 1.5 min/cycle.

Further, after the intermittent pouring job was carried out 100 times, the door (frame 7) was opened through the hinge, a job for observing the surface state of the fixed plate brick 2 and the slide plate brick 5 and reversing and mounting the respective bricks was carried out.

Even after the molten cast iron was poured 100 times, no external leakage was admitted from the poured molten metal quantity control device of the present invention. Further, no abnormality was admitted in a pouring port open/close job carried out each time.

It was determined that the surface of the respective bricks after 100 cycles had still no problem in practical use although a somewhat strong trace was admitted in the vicinities of the poring ports. Further, the reversing and mounting job could be smoothly carried out without any relation to the turn system.

EMBODIMENT 2

FIG. 3 is a schematic view showing a structure of a double door type in an embodiment 2 of the present invention, wherein FIG. 3(*a*) is a view observed from a pouring side, and FIG. 3(*b*) is a view observed from a side surface.

FIG. 4 is an explanatory view schematically showing a structure of the embodiment 1.

In the figure, 61 denotes a slide plate hinge portion. Note that the same components as those shown in FIGS. 1 and 2 of the embodiment 1 are denoted by the same reference numerals and the description thereof is omitted.

The embodiment is different from the embodiment 1 in that a slide plate 6, in which a slide plate brick 5 is accommodated, is also pivotally opened and closed independently with respect to a frame 7 through a hinge portion 42 likewise the frame 7 to easily carry out a job for reversing and mounting the slide plate brick 5. Further, a fixed plate 3 as a fixed plate brick receiver is provided which can be turned with respect to an outer race 4 for accommodating a fixed plate brick which is fixed to the base plate in the embodiment 1 so that it can be pivotally opened and closed through a hinge. The axial centers of all the hinges are disposed on the same axis.

FIG. 6 is an explanatory view explaining steps of reversing the positions of a fixed plate brick 2 and the slide plate brick 5. FIGS. 6(*a*)-(*d*) show respective STEPS 1-4.

At STEP 1, (1) the frame 7 is opened up to 120° after a lock nut of a clamp for fixing the frame 7 is loosened, and (2) the position of the slide plate brick 5 is reversed. Next, at STEP 2, the slide plate 6 in which the slide plate brick 5 is accommodated is opened up to 120°. At STEP 3, (1) the fixed plate brick receiver (door) including the outer race 4 in which the fixed plate brick 2 is accommodated is opened up to 120°, and (2) the position of the fixed plate brick is reversed. At STEP 4, all the doors are closed.

With this embodiment, there can be provided a poured molten metal quantity control device that can easily reverse the positions of the fixed plate brick 2 and the slide plate brick 5 at the time when they are worn, while secure and smooth control of the opening/closing of the pouring ports executed by the hydraulic cylinder as shown in the embodiment 1 is preserved.

EMBODIMENT 3

In FIG. 7, a ratio k value between the axial output F of the hydraulic cylinder and the turn torque T of the turn system is calculated with respect to the turn angle θ of the turn system in the embodiments 1 and 2.

Radius of turn of outer race R: R=420

Distance H between P1 and P3: H=852.5 mm

Rod stroke of hydraulic cylinder Lx:

When an angle between the distance H between P1 and P2 with respect to the support pivot P1 and the rod stroke Lx of the hydraulic cylinder is shown by β, the turn torque T is shown by $T=F\sin(\theta+\beta)=KF$, and FIG. 7 shows the K value to a turn angle θ.

In the embodiments, it can be found that the maximum value of the turn torque T appears at about θ=65°, and about θ=45° to 95° is necessary to keep about 90% of the maximum value.

FIG. 8 is a view showing a result of an actual measurement in which the turn torque T in the embodiment 1 was actually measured using the turn angle θ as a parameter. The initial value of the turn torque at the start from a completely closed pouring port was about 8.2 KN·m, and a necessary torque in the range of the turn angle 90°, which was necessary until the pouring port was completely opened, was approximately constant and about 2.7 KN·m.

Further, the initial value of torque at the start from a completely open pouring port was dispersed from about 4 to 8 KN·m, and a necessary torque was approximately constant and about 2.5 KN·m in the range of the turn angle of 90° until the turn system was turned and stopped in a completely closed state.

Accordingly, a torque of 90% of the K value is generated at the start position of the turn torque. That is, it can be found that the hydraulic cylinder can make an effective selection by selecting and arranging the position P1, H, R, and L to set the turn angle θ such that the maximum value of the K value or at least 90% of the K value is generated at the start position of the turn torque.

Moreover, a feature of the embodiments resides in that the rod stroke 0 position of the hydraulic cylinder 8 is matched to the completely open position of the pouring port. Accordingly, the terminate position obtained by completely closing the pouring port is matched to the entire length position of the rod stroke of the hydraulic cylinder 8.

Since the initial state (position of rod stroke 0) of the hydraulic cylinder 8 must be matched to the pouring port completely open position in a traditional method of use of the hydraulic cylinder 8, it may be said this is an inverse use to the traditional method of use.

However, the embodiments are characterized in that safety and maintainability are given precedence. More specifically, the embodiments intend to abruptly stop a pouring operation at the time when emergency occurs during the pouring operation of molten metal, and to prevent the operation of the hydraulic cylinder 8 to close the pouring port from being disturbed by the droplets of molten metal which have been deposited on the rod of the hydraulic cylinder 8 during the pouring operation at the completely open position of the pouring port. That is, the embodiments are characterized in that the initial state (position of rod stroke 0) of the hydraulic cylinder 8 is matched to the completely open position of the pouring port.

It is needless to say that the completely open position of the pouring port can be matched to the entire length state of the stroke of the hydraulic cylinder 8. In this case, however, an output corresponding to the area of the rod of the hydraulic cylinder 8 must be increased, and further a countermeasure such as a cover for droplets is required.

Note that specification such as the dimensions of the respective embodiments of the present invention show only an example of the embodiments, and the specification is not limited to those described above as long as they are within the basic arrangement of the present invention. Further, in the embodiments, although only the hydraulic cylinder is described as the expandable unit, an air cylinder, a screw type unit, a rack/pinion type unit, and the like that have the same purpose can be also used.

INDUSTRIAL APPLICABILITY

The poured molten metal quantity control device can be used to control the pouring feed rate of not only molten steel but also light metal such as aluminum alloy, etc. and synthetic resin, etc., as well as a fluid such as paint, sludge, and the like.

REFERENCE NUMBERALS

Figure 1:
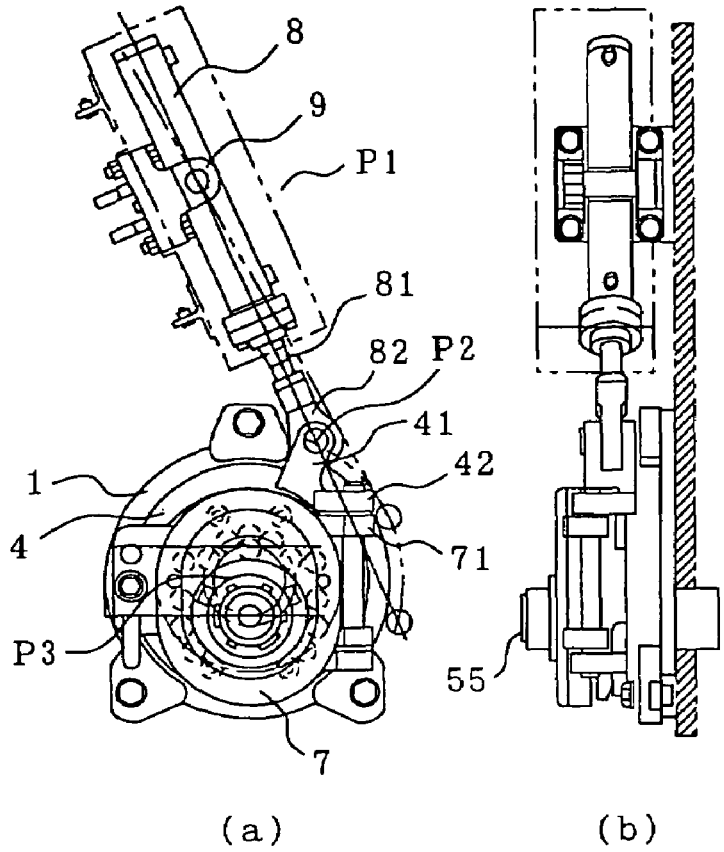
FIG. 1 is a schematic view showing a structure of a single door type in an embodiment 1 of the present invention, wherein FIG. 1(*a*) is a view observed from a pouring side, and FIG. 1(*b*) is view observed from a side surface.
Figure 2:
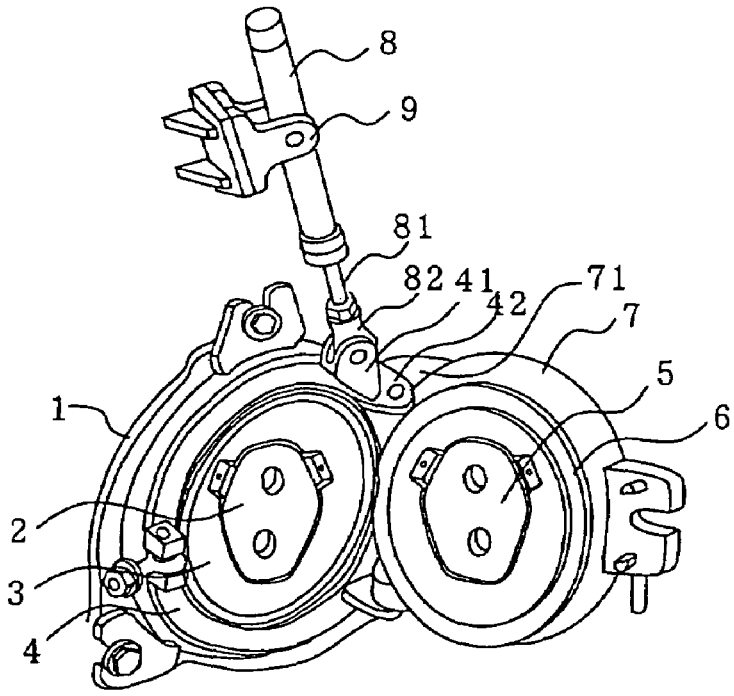
FIG. 2 is an explanatory view schematically showing a structure of the embodiment 1.
Figure 3:
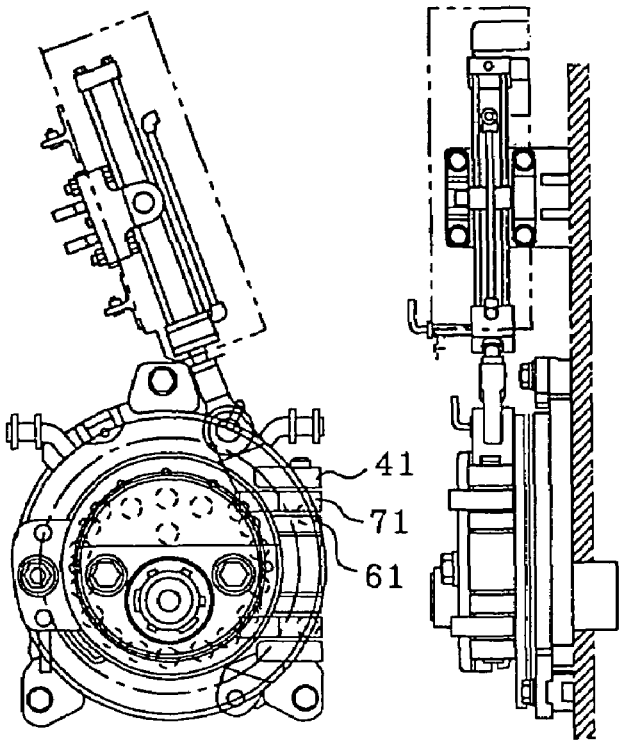
FIG. 3 is a schematic view showing a structure of a double door type in an embodiment 2 of the present invention, wherein FIG. 3(*a*) is a view observed from a pouring side, and FIG. 1(*b*) is view observed from a side surface.
Figure 4:
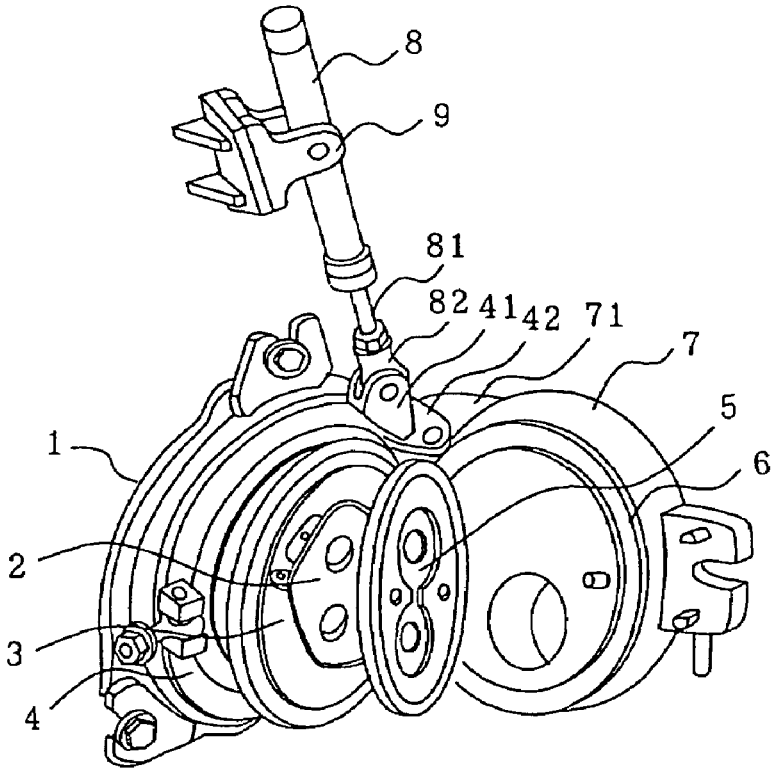
FIG. 4 is an explanatory view schematically showing the structure of the embodiment 1.
Figure 5:
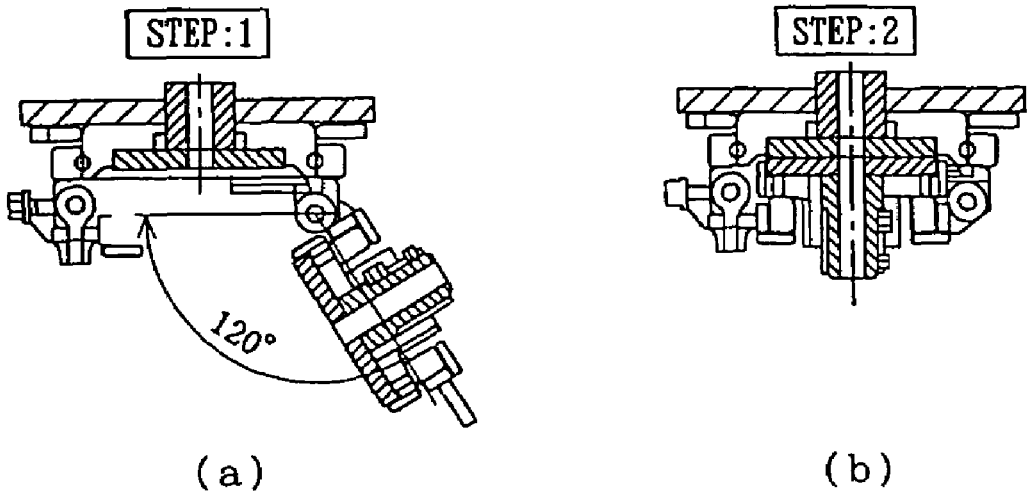
FIG. 5 is an explanatory view explaining steps of reversing the positions of a fixed plate brick and a slide plate brick in the embodiment 1 of the present invention.
Figure 6:
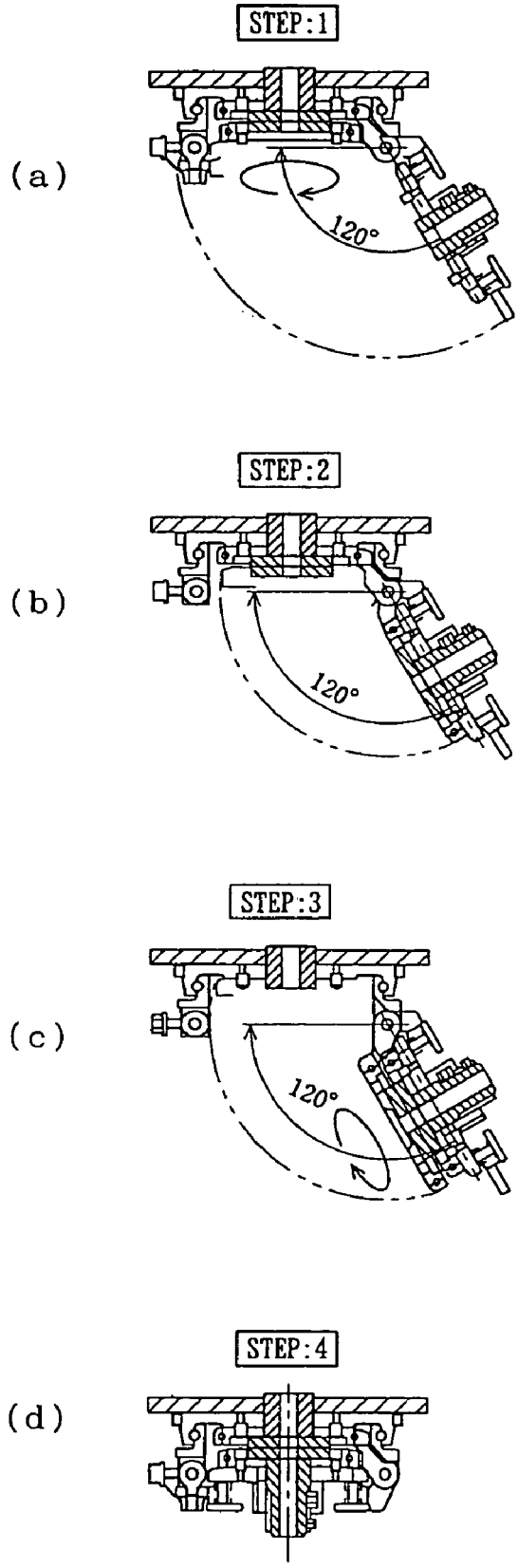
FIG. 6 is an explanatory view explaining steps of reversing the positions of a fixed plate brick 2 and a slide plate brick 5 in the embodiment 2 of the present invention.
Figure 7:
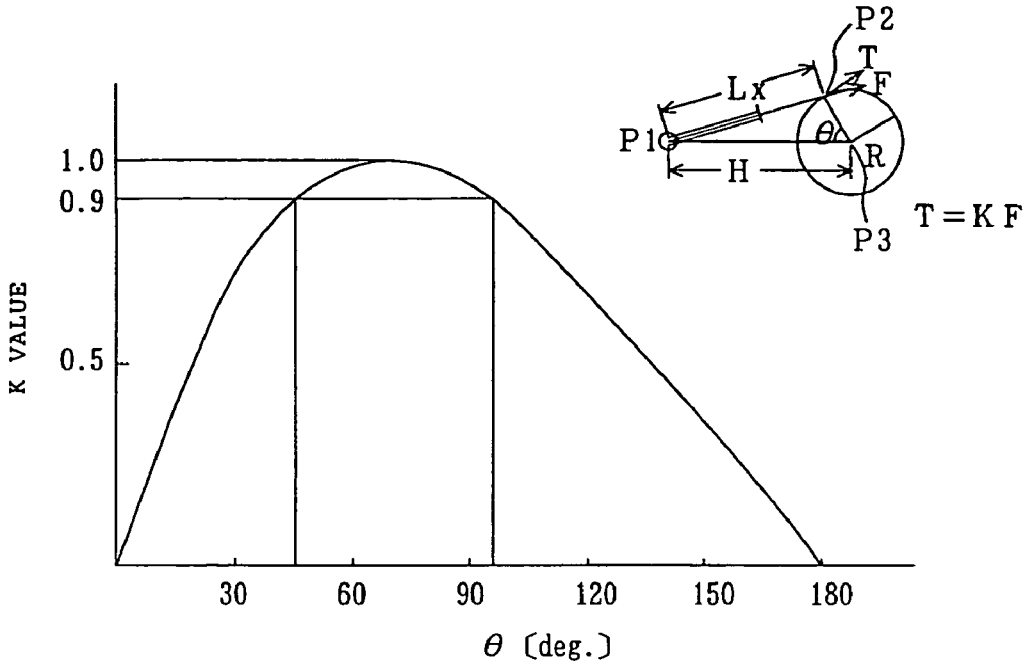
FIG. 7 is a view showing the relation of a ratio K to the turn angle θ of a turn system.
Figure 8:
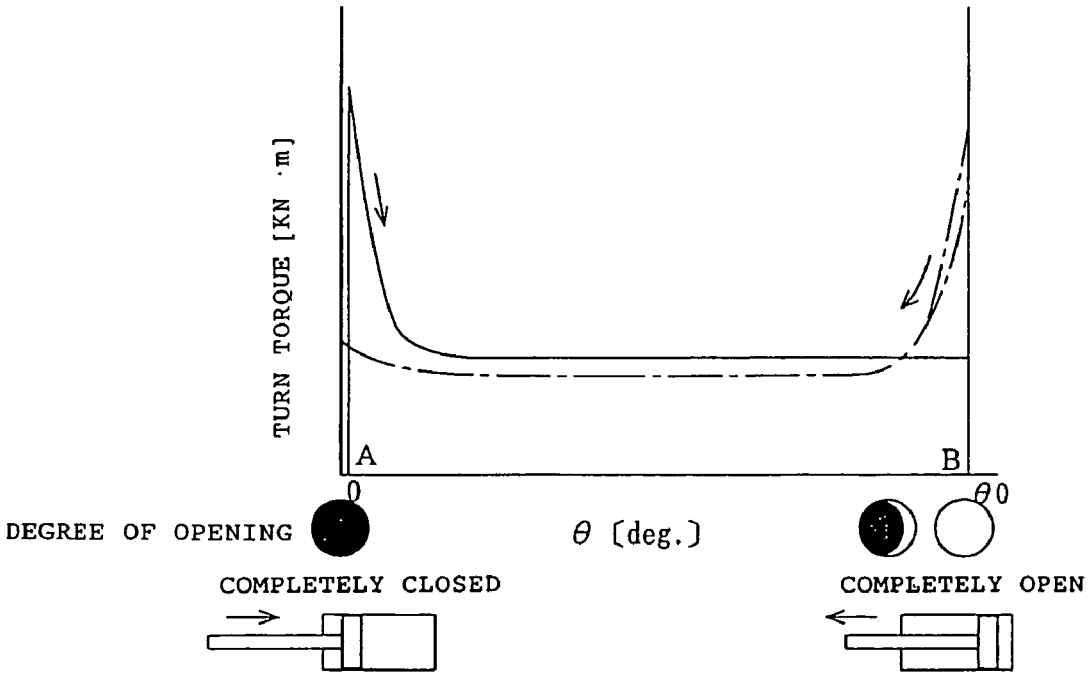
FIG. 8 is a view showing the relation between a turn torque T and a turn angle θ.
Figure 9:
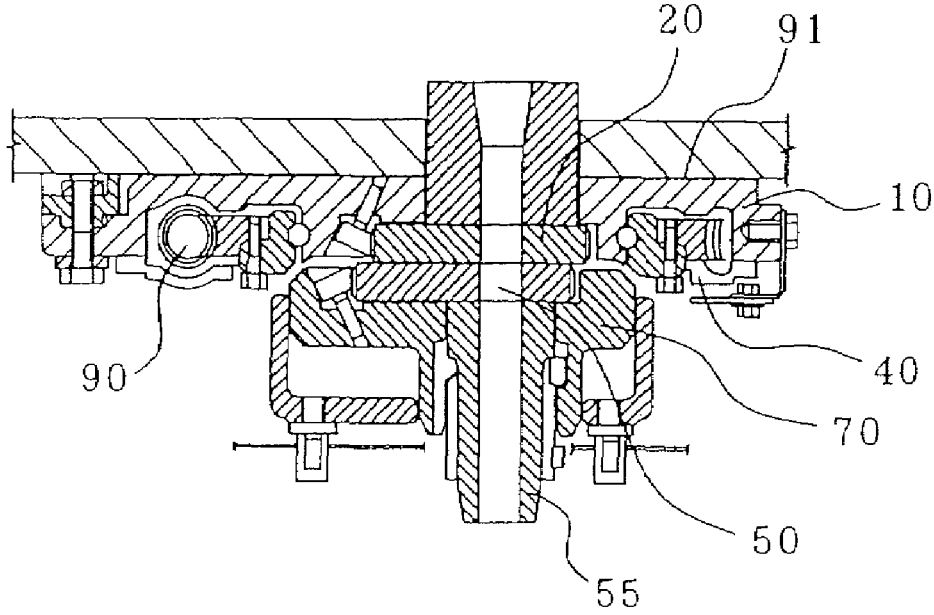
FIG: 9 (PRIOR ART)
FIG. 9 is a view showing an example of a conventional rotary type poured molten metal quantity control device.
Figure 10:
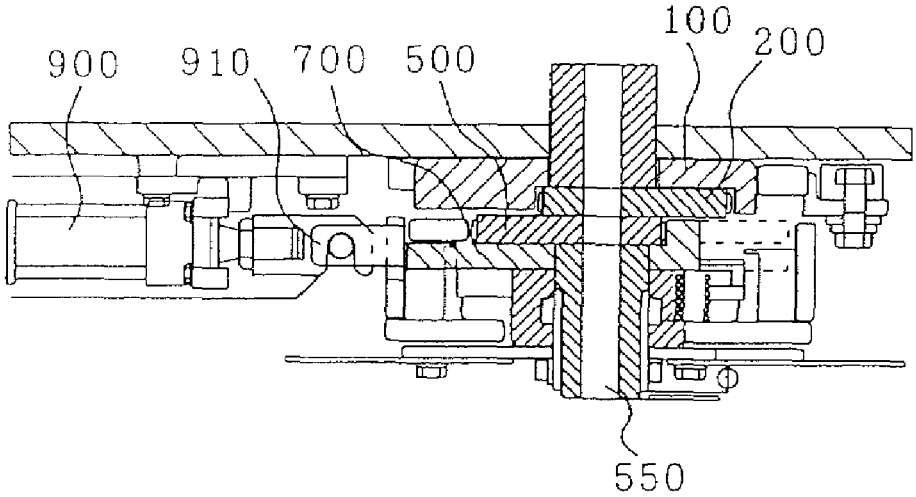
FIG. 10 (PRIOR ART)
FIG. 10 is a view showing an example of a conventional linear slide type poured molten metal quantity control device.

1:base plate
2: fixed plate brick
3: fixed plate
4: outer race
41: coupling portion
42: hinge portion
5: slide plate brick
6: slide plate case
61: slide plate hinge portion
7: frame
71: frame hinge portion
8: hydraulic cylinder
82: coupling end portion
9: cylinder pivot portion
P1: support pivot for supporting extendable unit
P2: pivot engaged with end of extendable rod of extendable unit disposed to outer peripheral portion of outer race
P3: center of turn of outer race

The invention claimed is:

1. A poured molten metal quantity control device for a rotary pouring apparatus, the device comprising:

a fixed plate brick mounted on the bottom of a molten metal vessel through a base plate and having at least one pouring port;

a collector nozzle brick disposed in confrontation with the fixed plate brick with its pouring port located concentrically;

a slide plate brick sandwiched between the collector nozzle brick and the fixed plate brick and being in contact therewith so as to slidingly turn on the sliding surfaces of the collector nozzle brick and the fixed plate brick and having at least one pouring port;

a frame on which the slide plate brick is mounted;

an outer race mounted on the outer peripheral side of the fixed plate brick so as to be turned by an extendable unit;

wherein the device controls the pouring amount of the molten metal by adjusting a relatively open position of the pouring port of the slide plate brick and the pouring port of the fixed plate brick by turning the outer race with the extendable unit;

wherein the frame is attached to the outer race through a pivotal hinge so as to be capable of opening and closing movements through the pivotal hinge independently of the turning of the outer race with the extendable unit, wherein the outer race is turned by a crank mechanism using triangle points consisting of a support pivot for supporting the extendable unit, the center of turn of the outer race, and a pivot engaged with an end of an extendable rod of the extendable unit and disposed on the outer peripheral portion of the outer race, and the stroke of the extendable unit and the position of the support pivot of the extendable unit are selected to provide a completely open position, in which the pouring port of the slide plate brick is aligned with the pouring port of the fixed plate brick, to form an end position, and a completely closed stop position, which is angularly offset from the end position by a predetermined angle, to form a start position, so that a turn stop position corresponds to a rotation angle between the completely open position and the completely closed position to an entire stroke of the extendable unit;

and wherein the position of the support pivot, the distance between the support pivot and the center of rotation, the radius of the turn of the outer race, and the entire stroke of the extendable unit are selected so that a turn angle is set at the start position to generate at least 90% of a maximum value of the ratio of a component force effective for the turn torque to an axial output of the extendable unit.

2. A poured molten metal quantity control device for a rotary pouring apparatus, the device comprising:

a fixed plate brick mounted on the bottom of a molten metal vessel through a base plate and having at least one pouring port;

a collector nozzle brick disposed in confrontation with the fixed plate brick with its pouring port located concentrically;

a slide plate brick sandwiched between the collector nozzle brick and the fixed plate brick, and being in contact therewith so as to slidingly turn on the sliding surfaces of the collector nozzle brick and the fixed plate brick and having at least one pouring port;

a frame on which the slide plate brick, into which the slide plate brick is internally fitted, is mounted, an outer race into which a fixed plate having the fixed plate brick is internally fitted and which is mounted on an outer peripheral side so as to be turned by an extendable unit;

wherein the device controls the pouring amount of the molten metal by adjusting a relatively open position of the pouring port of the slide plate brick and the pouring port of the fixed plate brick by turning the outer race with the extendable unit;

wherein the frame, the slide plate, and the fixed plate are attached to the outer race through pivotal hinges on coaxial hinge shafts, respectively so as to be capable of opening and closing movements on the pivotal hinges independently of the turning of the outer race with the extendable unit;

wherein the outer race is turned by a crank mechanism using triangle points consisting of a support pivot for supporting the extendable unit, the center of turn of the outer race, and a pivot engaged with an end of an extendable rod of the extendable unit and disposed on the outer peripheral portion of the outer race, and the stroke of the extendable unit and the position of the support pivot of the extendable unit are selected to provide a completely open position in which the pouring port of the slide plate brick is aligned with the pouring port of the fixed plate brick, to form an end position, and a completely closed stop position, which is angularly offset from the end position by a predetermined angle to form a start position, so that a turn stop position corresponds to a rotation angle between the completely open position and the completely closed position to an entire stroke of the extendable unit;

and wherein the position of the support pivot, the distance between the support pivot and the center of rotation, the radius of the turn of the outer race, and the entire stroke of the extendable unit are selected so that a turn angle is set at the start position to generate at least 90% of a maximum value of the ratio of a component force effective for the turn torque to an axial output of the extendable unit.

3. A poured molten metal quantity control device according to claim 1, wherein the extendable unit is a hydraulic or air cylinder unit.

4. A poured molten metal quantity control device according to claim 1, wherein the extendable unit is a screw type unit.

5. A poured molten metal quantity control device according to claim 1, wherein the extendable unit is a rack/pinion type unit.

6. A poured molten metal quantity control device according to claim 1, wherein the end position and the start position respectively correspond to the stroke and entire length positions of the extendable rod of the extendable unit.

7. A poured molten metal quantity control device according to claim 1, wherein a turn angle between the radius of turn of the start position and the center line connecting between the support pivot and the pivot engaged with the end of the extendable rod is 90°±30°.

8. A poured molten metal quantity control device according to claim 1, wherein the pouring port of the fixed plate brick and the pouring port of the slide plate brick are two or three pouring ports disposed in symmetry with respect to a turn direction.

9. A poured molten metal quantity control device according to claim 1, wherein the slide plate brick is internally mounted in a sliding plate case reversibly attached to the frame.

10. A poured molten metal quantity control device according to claim 9, wherein the fixed brick is further reversibly attached to a bottom plate case engaged with the base plate through a pivotal hinge.

* * * * *

UNITED STATES PATENT AND TRADEMARK OFFICE

CERTIFICATE OF CORRECTION

PATENT NO. : 7,546,937 B2
APPLICATION NO. : 10/582472
DATED : June 16, 2009
INVENTOR(S) : Tsuneo Kondo et al.

It is certified that error appears in the above-identified patent and that said Letters Patent is hereby corrected as shown below:

Title page, item (73), assignees are:

JFE Refractories Corporation (jointly held with Nippon Rotary Nozzle Co., Ltd.; JFE Mechanical Co., Ltd. and TYK Corporation)

Signed and Sealed this

Fourth Day of May, 2010

David J. Kappos

David J. Kappos
*Director of the United States Patent and Trademark Office*